US007173581B2

(12) United States Patent
Kumakura et al.

(10) Patent No.: US 7,173,581 B2
(45) Date of Patent: Feb. 6, 2007

(54) PLASMA DISPLAY APPARATUS

(75) Inventors: Ken Kumakura, Kawasaki (JP); Yoshikazu Kanazawa, Kawasaki (JP); Hideaki Ohki, Yokohama (JP); Takashi Fujisaki, Kawasaki (JP); Atsushi Yokoyama, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 506 days.

(21) Appl. No.: 10/796,107

(22) Filed: Mar. 10, 2004

(65) Prior Publication Data

US 2004/0239590 A1 Dec. 2, 2004

(30) Foreign Application Priority Data

May 30, 2003 (JP) ..... 2003-154210

(51) Int. Cl.
*G09G 3/28* (2006.01)

(52) U.S. Cl. ..... 345/62

(58) Field of Classification Search ..... 345/60–68; 315/169.1, 169.4, 169.3
See application file for complete search history.

(56) References Cited

U.S. PATENT DOCUMENTS

| | | | | |
|---|---|---|---|---|
| 6,172,465 | B1 * | 1/2001 | Huang | 315/169.3 |
| 6,373,452 | B1 | 4/2002 | Ishii et al. | 345/67 |
| 6,603,446 | B1 | 8/2003 | Kanazawa et al. | 345/60 |
| 6,747,615 | B2 * | 6/2004 | Jeong | 345/60 |
| 6,965,359 | B2 * | 11/2005 | Ishii et al. | 345/63 |

FOREIGN PATENT DOCUMENTS

| | | |
|---|---|---|
| JP | 9-160525 | 6/1997 |
| JP | 11-327503 | 11/1999 |

* cited by examiner

*Primary Examiner*—Richard Hjerpe
*Assistant Examiner*—Kevin M. Nguyen
(74) *Attorney, Agent, or Firm*—Staas & Halsey LLP

(57) ABSTRACT

An ALIS system PDP apparatus in which a reduction in the variation in luminance due to ringing has been reduced is disclosed. In an ALIS system PDP apparatus, X (first) electrodes and Y (second) electrodes are arranged in such a way that the X electrodes and the Y electrodes, whose path length, which is the length of each of the signal paths of a sustain discharge pulse from the X and Y electrode to sustain drive circuits, is longer or shorter than that of the peripheral X and Y electrodes, do not exist densely. Specifically, the order of arrangement of the odd and even X sustain drive circuits is reversed to that of odd and even Y sustain drive circuits.

4 Claims, 9 Drawing Sheets

PLASMA DISPLAY APPARATUS

BACKGROUND OF THE INVENTION

The present invention relates to a plasma display apparatus (PDP apparatus) having an AC (alternating current) type plasma display panel (PDP). More particularly, the present invention relates to an ALIS system PDP apparatus which carries out an interlaced display in which every gap between neighboring sustain electrodes is utilized as a display line and odd-numbered display lines and even-numbered display lines are displayed alternately for each display frame.

The PDP apparatus using an AC type PDP is put to practical use and widely used as a thin large-screen display apparatus. Japanese Unexamined Patent Publication (Kokai) No. 9-160525 describes the ALIS system PDP apparatus in which the number of display lines is doubled without changing the number of electrodes. Japanese Unexamined Patent Publication (Kokai) No. 11-327503 has disclosed a configuration for an ALIS system PDP apparatus, which realizes a sustain driver for applying a sustain discharge voltage pulse to first electrodes (X electrodes) and second electrodes (Y electrodes) (referred to as sustain electrodes, altogether) by the use of a low maximum rating element. The present invention can be applied to the ALIS system PDP apparatus disclosed in Japanese Unexamined Patent Publication (Kokai) No. 9-160525 and Japanese Unexamined Patent Publication (Kokai) No. 11-327503.

FIG. 1 is a block diagram showing the outline of the ALIS system PDP apparatus disclosed in the above-mentioned Japanese Unexamined Patent Publication (Kokai) No. 11-327503. As shown in FIG. 1, a panel 1 is provided with first electrodes X and second electrodes Y extending in a first direction (transverse direction in this diagram) and spaced alternately, and address electrodes A extending in a second direction (longitudinal direction in this diagram) perpendicular to the first direction and arranged at identical intervals. In the ALIS system PDP apparatus, a display line is formed in every gap between neighboring X electrode and Y electrode. In other words, when 501 X electrodes and 500 Y electrodes are provided, a display line is formed between each Y electrode and one of its neighboring X electrodes, and between itself and the other neighboring electrode, that is, 1,000 display lines in total are formed. A display cell C is formed at the crossing of each display line (between X electrode and Y electrode) and the address electrode.

Each address electrode A is driven by an address driver 11 and a voltage pulse is applied independently of the address driver 11. Each X electrode is driven by a first (X) electrode drive circuit 12. The first electrode drive circuit 12 has an odd X sustain driver (X-odd) 13 and an even X sustain driver (X-even) 14. The odd-numbered X electrode is driven by the odd X sustain driver 13 and a sustain discharge pulse is applied at the time of sustain discharge. The even-numbered X electrode is driven by the even X sustain driver 14 and a sustain discharge pulse is applied at the time of sustain discharge. The phase of the sustain discharge pulse to be applied to the odd-numbered X electrode is opposite to that of the sustain discharge pulse to be applied to the even-numbered X electrode. Each Y electrode is driven by a second (Y) electrode drive circuit 15. The second electrode drive circuit 15 has a scan driver 16, an odd Y sustain driver (Y-odd) 17 and an even Y sustain driver (Y-even) 18. Each Y electrode is driven by the scan driver 16 and a scan pulse is applied sequentially at the time of addressing. At the time of sustain discharge, the odd Y sustain driver 17 applies a sustain discharge pulse to the odd-numbered Y electrode via the scan driver 16 and the even Y sustain driver 18 applies a sustain discharge pulse to the even-numbered Y electrode via the scan driver 16. The phase of the sustain discharge pulse to be applied to the odd-numbered Y electrode is opposite to that of the sustain discharge pulse to be applied to the even-numbered X electrode, and the phase of the sustain discharge pulse to be applied to the odd-numbered x electrode is the same as that of the sustain discharge pulse to be applied to the even-numbered Y electrode.

The sustain discharge pulse is a pulse of about 200V, and the phase of the sustain discharge pulse to be applied to the odd-numbered X electrode is opposite to that of the sustain discharge pulse to be applied to the even-numbered X electrode, and the phase of the sustain discharge pulse to be applied to the odd-numbered Y electrode is opposite to that of the sustain discharge pulse to be applied to the even-numbered Y electrode, therefore, as a result, a very large voltage is applied to each part of the drive element and it is necessary to use a high maximum rating element, if the odd X sustain driver 13 and the even X sustain driver 14 are integrated into one chip, or the scan driver 16, the odd Y sustain driver 17 and the even Y sustain driver 18 are integrated into one chip. Because of this, there arises a problem: the cost of the drive circuit is pushed up and a sufficient operation speed is difficult to obtain. To solve this problem, Japanese Unexamined Patent Publication (Kokai) No. 11-327503 has proposed that the scan driver 16 is divided into an odd scan driver for driving the odd-numbered Y electrode and an even scan driver for driving the even-numbered Y electrode, which are formed on separate chips, respectively, the odd Y sustain driver 17 and the even Y sustain driver 18 are formed on separate chips, respectively, and the odd X sustain driver 13 and the even X sustain driver 14 are formed on separate chips, respectively. In this manner, it is possible to reduce the voltage to be applied to the elements in a chip, and low maximum rating elements can be used.

As the ALIS system PDP apparatus shown in FIG. 1 is explained in detail in the above-mentioned Japanese Unexamined Patent (Kokai) No. 9-160525 and Japanese Unexamined Patent Publication (Kokai) No. 11-327503, no more detailed explanation is given here.

FIG. 2 is a diagram showing a layout when drive circuit parts relating to the X electrode and the Y electrode in the PDP apparatus shown in FIG. 1 are mounted. As shown schematically, on the left side of the panel 1 are provided the terminals of the X electrodes so that the X electrodes can be connected to the outside via connectors 41 and 42. Similarly, on the right side of the panel 1 are provided the terminals of the Y electrodes so that the Y electrodes can be connected to the outside via connectors 43 and 44. A circuit substrate 21 is provided with a sustain driver (X-odd) 22 for driving odd-numbered x electrodes and a sustain driver (X-even) 23 for driving even-numbered X electrodes, and a signal line 24 of the X-odd 22 and a signal line 25 of the X-even 23 are connected to the odd-numbered X electrodes and the even-numbered X electrodes via the connectors 41 and 42, respectively. As shown schematically, the panel 41 connects the X electrodes on the upper half side of the panel 1, the X electrodes including the odd-numbered and even-numbered X electrodes. Similarly, the connector 42 connects the X electrodes on the lower half side of the panel 1, the X electrodes including the odd-numbered and even-numbered x electrodes.

A circuit substrate 31 is provided with a plurality of scan driver elements 32 making up the scan driver 16, a sustain driver (Y-odd) 33 for driving the odd-numbered Y electrodes and a sustain driver (Y-even) 34 for driving the even-numbered Y electrodes. The plurality of scan driver elements 32 are divided into odd driver elements for driving the odd-numbered Y electrodes and even driver elements for driving the even-numbered Y electrodes, and the odd driver elements and the even driver elements are arranged alternately. A signal line 35 of the Y-odd 33 is connected to the odd driver elements and a signal line 36 of the Y-even 34 is connected to the even driver elements. The output lines of the odd driver elements and the even driver elements are connected to the corresponding odd-numbered Y electrodes and even-numbered Y electrodes via the connectors 43 and 44, respectively, in the order of the arrangement. Here, the four odd driver elements and the four even driver elements are provided, respectively, and the output lines of the two odd driver elements and the two even driver elements arranged on the upper half side in the figure are connected to the Y electrodes on the upper half side of the panel 1 via the connector 43. Similarly, the two odd driver elements and the two even driver elements arranged on the lower half side in the figure are connected to the Y electrodes on the lower half side of the panel 1 via the connector 44. The X-odd 22, the X-even 23, the Y-odd 33 and the Y-even 34 are realized by the use of elements having the same specifications.

As the drive circuit is provided on a circuit substrate different from the glass of the panel, a connector is required for connecting the output line of the drive circuit and the electrode terminal of the panel. As there are about 500 X electrodes and 500 Y electrodes, respectively, it is difficult to connect the X electrodes or Y electrodes with one connector, therefore, the X electrodes or the Y electrodes are divided into the upper half group and the lower half group and connected via two connectors.

SUMMARY OF THE INVENTION

The PDP apparatus according to the present invention is an ALIS system PDP apparatus, in which, the first electrodes and the second electrodes, whose path lengths, that is, each of the length of the signal path of the sustain discharge pulse from the first and second electrodes to the first odd electrode drive (odd X sustain) circuit, that to the first even electrode drive (even X sustain) circuit, that to the second odd electrode drive (odd Y sustain) circuit, and that to the second even electrode drive (even Y sustain) circuit, is longer or shorter than the path length of the first electrodes and the second electrodes which exist peripherally, do not exist densely. For example, when four or more of the first electrodes and the second electrodes whose path length is different from that of peripheral ones do not exist successively, it can be said that such electrodes do not exist densely.

The first electrodes and the second electrodes of the panel are connected to the odd X sustain circuit, even X sustain circuit, odd sustain circuit, and even Y sustain circuit via two connectors provided at both ends of the panel in the direction in which the first electrodes and the second electrodes extend.

In a specific configuration which realizes the above-mentioned condition, when the odd X sustain circuit and the even X sustain circuit, and the odd Y sustain circuit and the even Y sustain circuit made up of separate elements, are arranged in parallel to the second direction (direction in which the address electrodes extend) perpendicular to the first direction, the order of arrangement of the odd X sustain circuit and the even X sustain circuit is reversed to the order of the arrangement of the odd Y sustain circuit and the even Y sustain circuit.

BRIEF DESCRIPTION OF THE DRAWINGS

The features and advantages will be more clearly understood from the following description taken in conjunction with the accompanying drawings, wherein.

DESCRIPTION OF THE PREFERRED EMBODIMENTS

Figure 2:
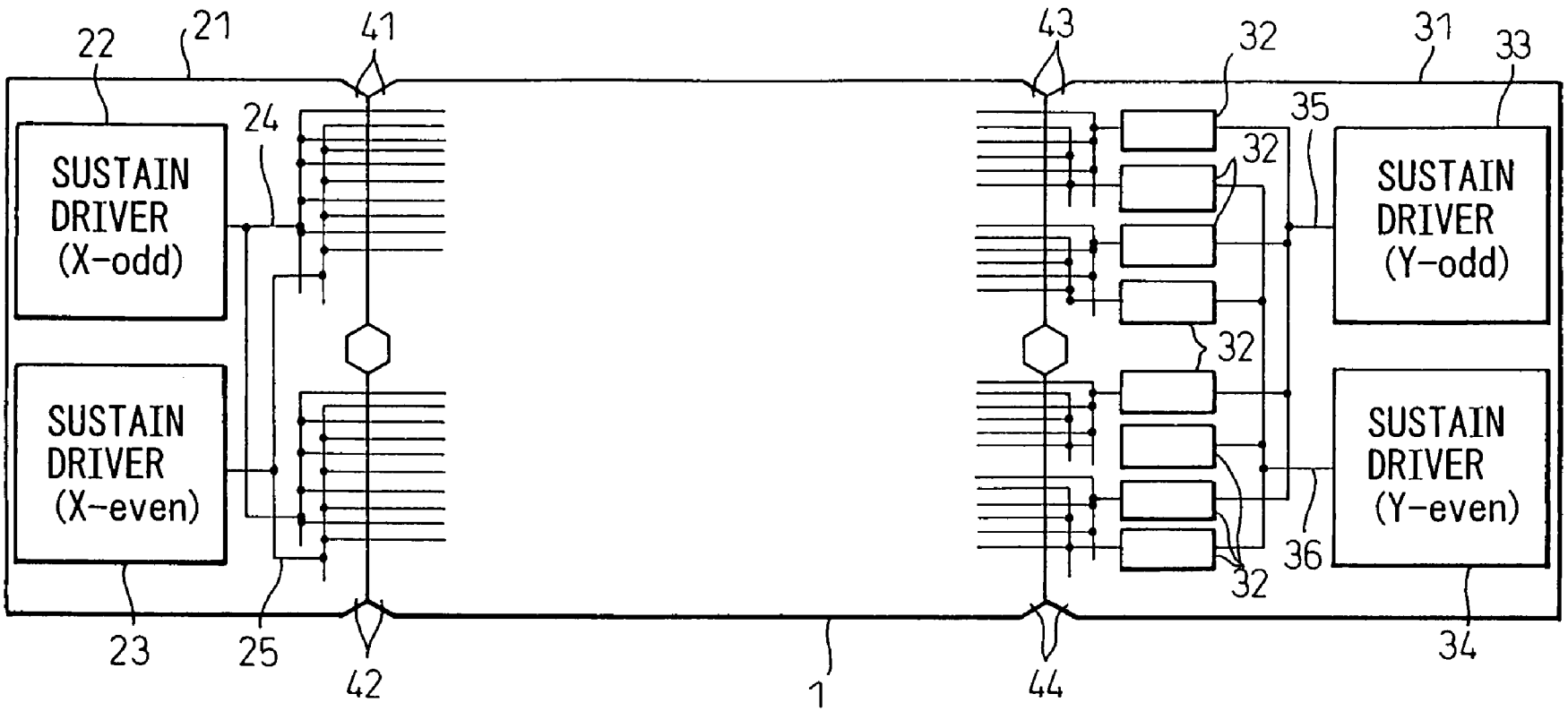
FIG. 2 is a diagram showing the arrangement of sustain drive circuit parts in a conventional PDP apparatus.
Figure 3A:
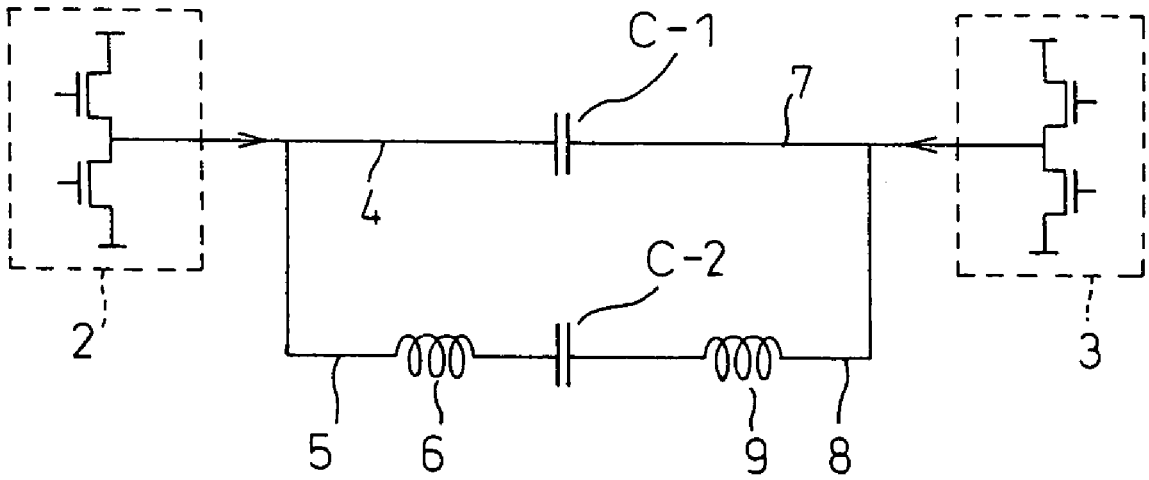
FIGS. 3A and 3B are diagrams for explaining the occurrence of a ringing.
Figure 3B:
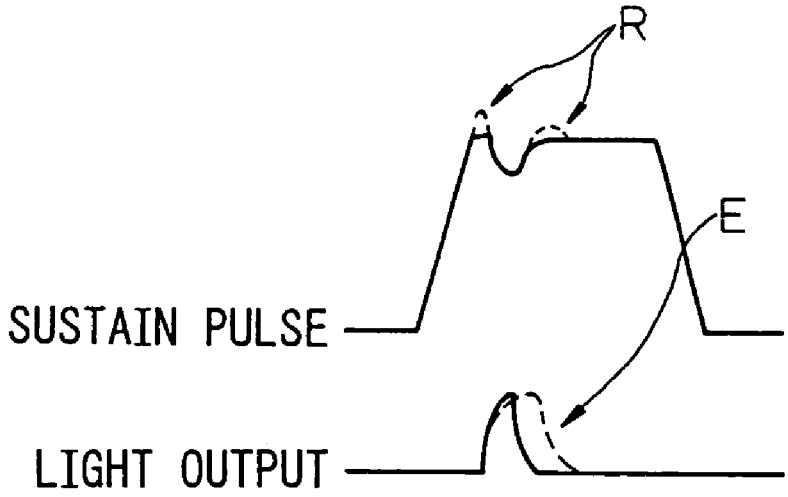

The drive circuit for sustain discharge of a conventional PDP apparatus has such a configuration as shown in FIG. 2, but the length of the signal path of the sustain discharge pulse from each X electrode and each Y electrode to the corresponding drive circuit and the area of the wiring pattern are different, therefore, the impedance and the parasitic inductance of the wire are different. The parasitic inductance of the signal path causes a phenomenon called ringing. FIGS. 3A and 3B are diagrams for explaining the occurrence of ringing.

Depending on the position of the X electrode and the Y electrode, the length of the signal path and the area of the wiring pattern differ, and a longer signal path has a larger parasitic inductance than a shorter signal path. In FIG. 3A, a signal path 4 from an X electrode sustain circuit 2 to the X electrode making up a cell C-1 is relatively short, a signal path 5 from the X electrode sustain circuit 2 to the X electrode making up a cell C-2 is relatively long, a signal path from a Y electrode sustain circuit 3 to the Y electrode making up the cell C-1 is relatively short, and a signal path 8 from the Y electrode sustain circuit 3 to the Y electrode making up the cell C-2 is relatively long. It is assumed here that an inductance 6 corresponding to the difference in parasitic inductance between the long signal path 5 and the short signal path 4, and an inductance 9 corresponding to that between the long signal path 8 and the short signal path 7 are provided in the long signal paths 5 and 8, respectively. As shown in FIG. 3B, when a sustain pulse is applied to the X electrode or the Y electrode, the sustain pulse voltage varies due to the parasitic inductance and the sustain pulse voltage is raised partly. This is called ringing. When ringing is present, the period of time of a sustain discharge is extended, as shown schematically, and the intensity is increased and the light output is increased. The magnitude of ringing, that is, the intensity of the light output varies in accordance with the magnitude of the parasitic inductance and when the ringing is large, the light output is also increased. Therefore, when the cell C-1 and the cell C-2 in FIG. 3A are sustain-driven, the luminance of the cell C-2 becomes higher.

Figure 1:
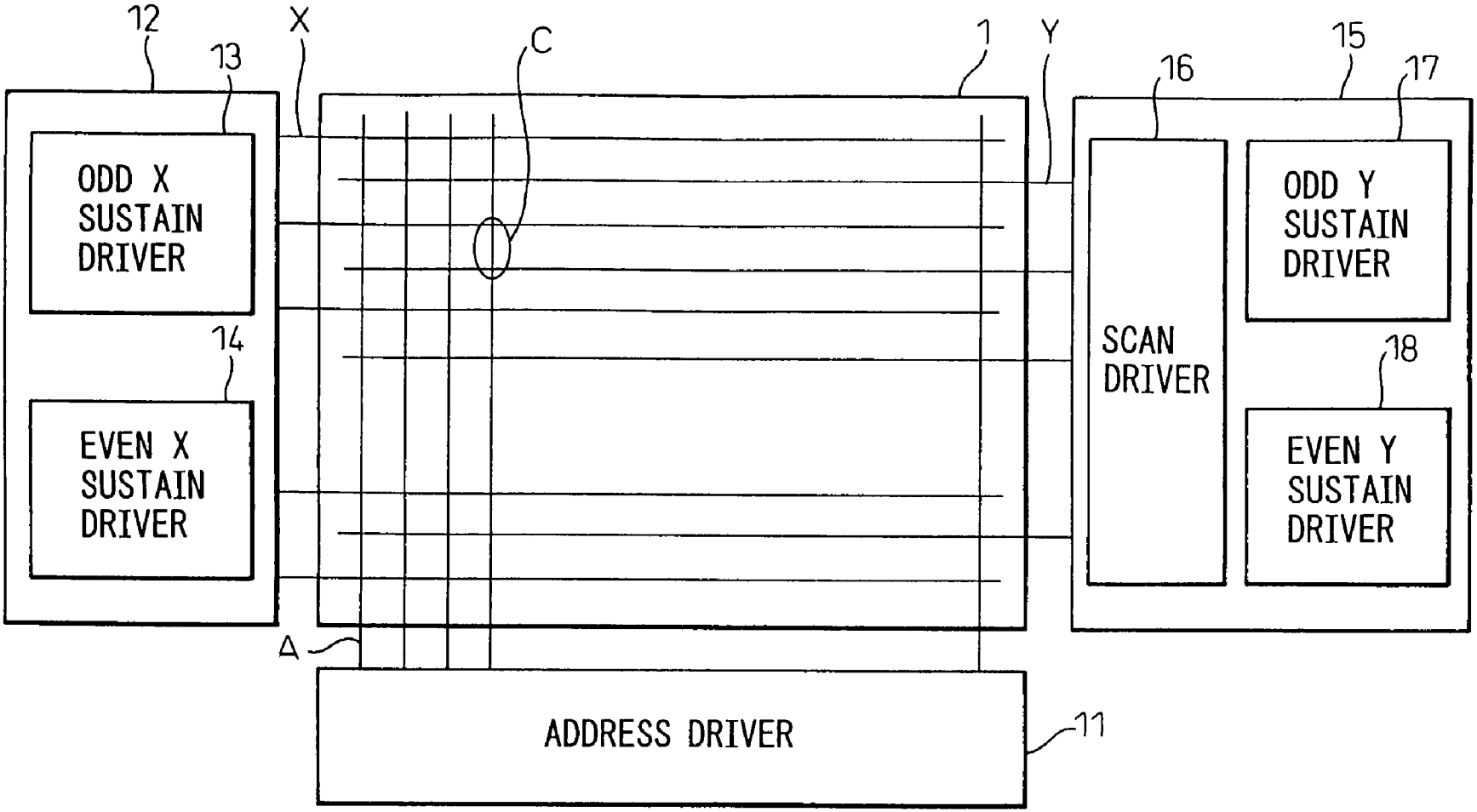
FIG. 1 is a block diagram showing the configuration of an ALIS system plasma display (PDP) to which the present invention is applied.
Figure 4:
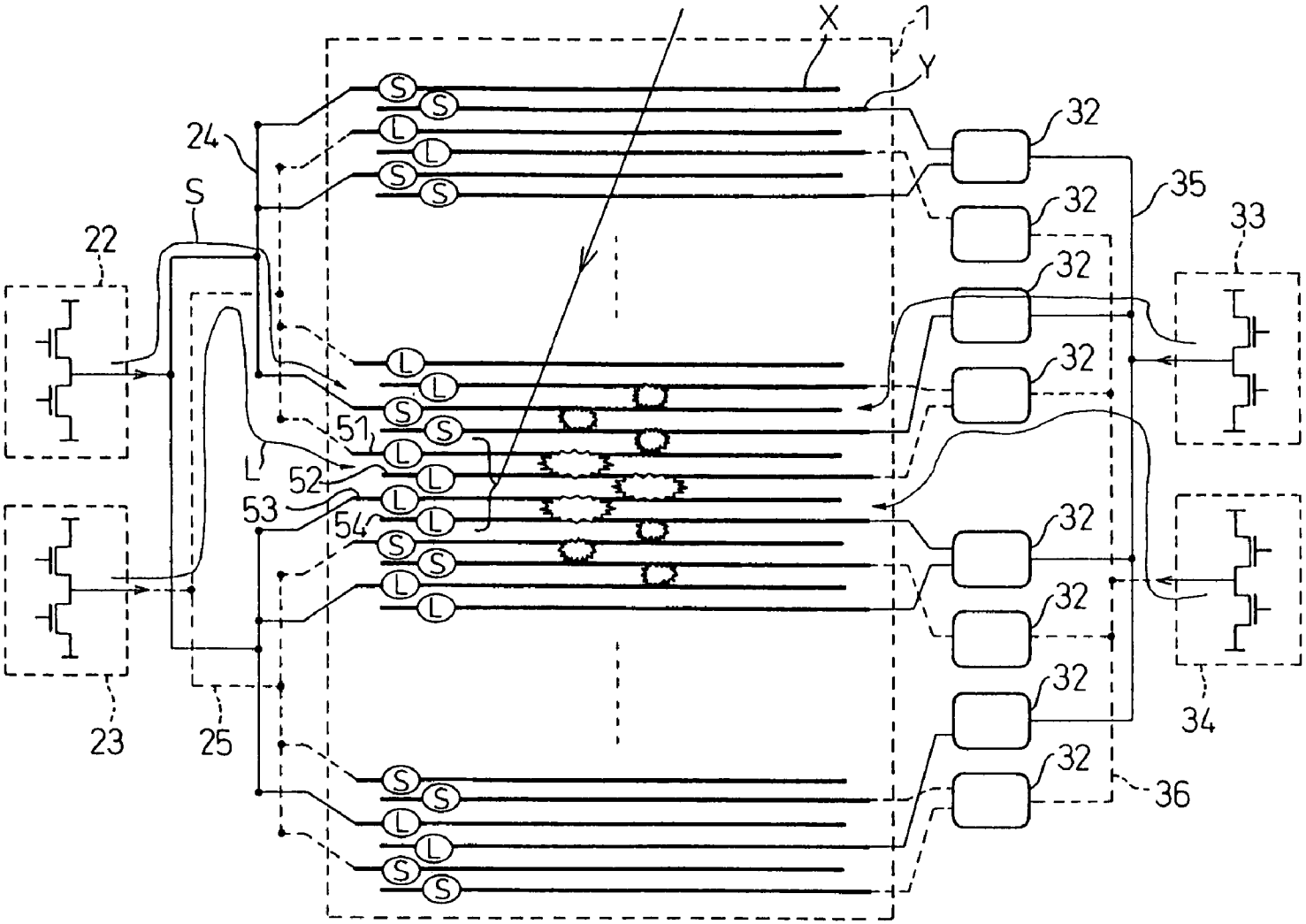
FIG. 4 is a diagram for explaining the occurrence of variations in luminance due to the ringing in the conventional PDP apparatus.

The variations in the intensity of light emission due to ringing are small and rather inconspicuous, but when there is a display line with a large ringing, or when there are several display lines with a small ringing situated rather densely and the state of the ringing of the peripheral display lines differs considerably, the variations become conspicuous and cannot be ignored. In the conventional PDP apparatus, even if there ringing exists, the state of ringing changes gradually across the entire screen and, therefore, the variations in luminance due to the ringing hardly bring about any problem. However, in the conventional ALIS system PDP apparatus shown in FIG. 1 and FIG. 2, there exist display lines with a large ringing in a large number situated densely at the central part of the screen and there exist display lines with a small ringing adjacent thereto, therefore, there arises a problem: variations in luminance become conspicuous. FIG. 4 is a diagram explaining the occurrence of the variations in luminance due to the ringing in the ALIS system PDP apparatus.

It is assumed that the panel 1 has 501 X electrodes and 500 Y electrodes. Here, the two hundred fiftieth X electrode 51 and Y electrode 52, and the two hundred fifty-first X electrode 53 and Y electrode 54 shown by the arrow are considered. The two hundred fiftieth X electrode 51 is connected to the X-even 23 via the connector 41 as shown by a path L. AS the X-even 23 is arranged far from the connector 41, the signal path (path length) becomes relatively long. The two hundred fiftieth Y electrode 52 also is connected to the Y-even 34 via the connector 43, therefore, the signal path becomes similarly long. As the two hundred fifty-first X electrode 53 is connected to the X-odd 22 via the connector 42, the signal path becomes long, and the two hundred fifty-first Y electrode 54 also is connected to the Y-odd 33 via the connector 44, therefore, the signal path becomes long. As described above, the signal paths of the four X electrodes and Y electrodes at the central part become long.

In contrast to this, a two hundred forty-ninth X electrode adjacent to the four X electrodes and Y electrodes is connected to the X-odd 22, which is situated nearer, via the connector 41 as shown by a path S, therefore, the signal path becomes relatively short. Similarly, the signal paths of a two hundred forty-ninth Y electrode and two hundred fifty-second X electrode and Y electrode become also short.

In FIG. 4, the path length of each X electrode and Y electrode is denoted by "LL" when the length is longer than those of peripheral ones, and "S", when shorter.

As described above, the signal lengths of the four X electrodes and Y electrodes at the central part are long and the luminance of the three display lines made up of these four electrodes becomes high, but the signal lengths of the X electrodes and Y electrodes adjacent to the four at the central part are short and the luminance of the display lines made up of these electrodes is low, therefore, lines with high luminance appear at the central part of the screen when, for example, the entire screen is lit at the same level, resulting in degradation of the display quality.

At other parts, a set of an X electrode and a Y electrode whose path lengths are long and a set of an X electrode and a Y electrode whose path lengths are short are arranged regularly by turns, therefore, the variations in luminance are inconspicuous.

The case described above is a case where display lines with a long signal path and a large ringing are situated densely, but also in another case where display lines with a small ringing are situated densely and display lines with a large ringing are situated adjacent thereto, the variations in luminance are conspicuous and lines with low luminance appear, resulting in degradation of the display quality.

Figure 5:
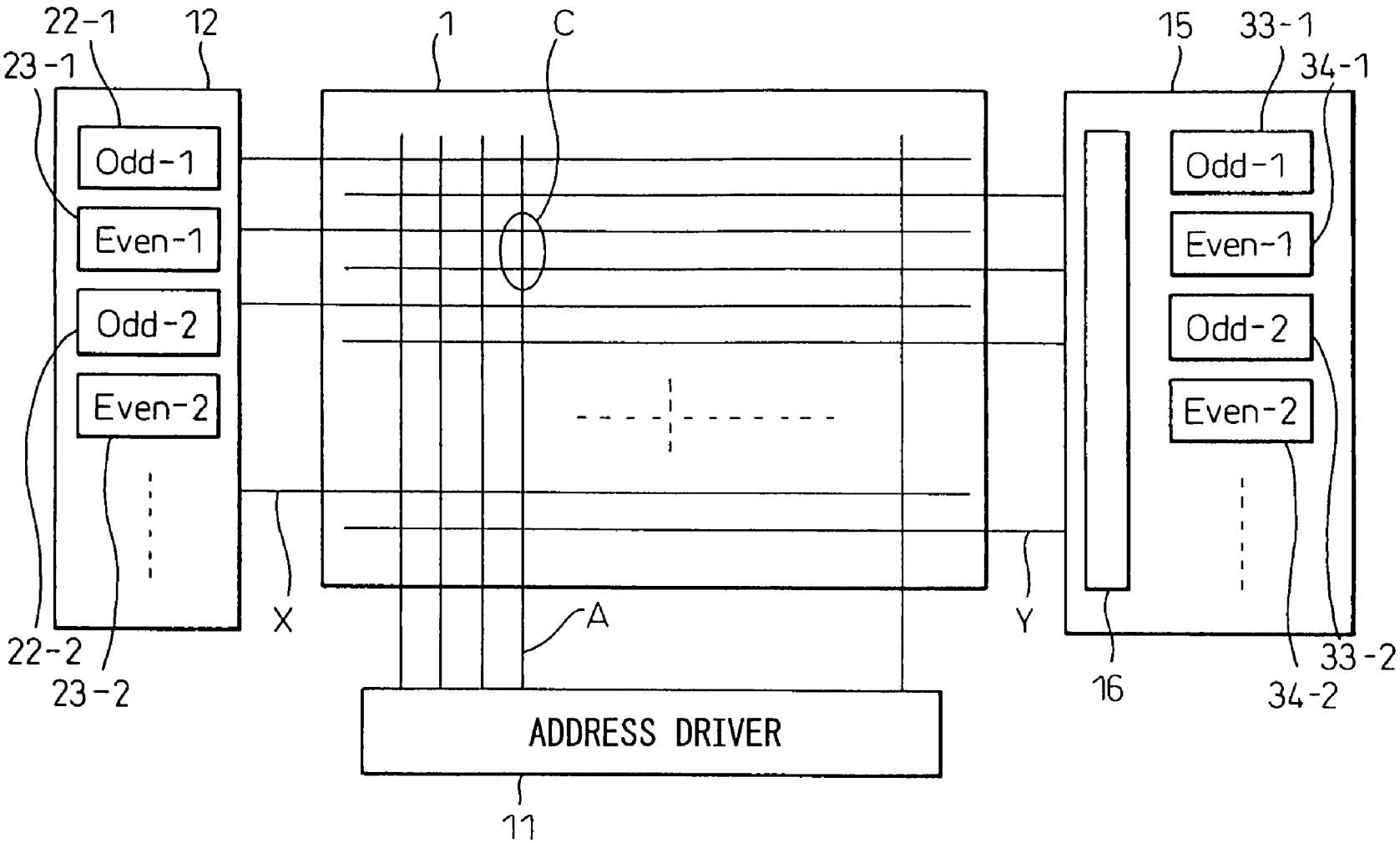
FIG. 5 is a diagram showing the configuration of a conventional PDP apparatus capable of suppressing the occurrence of variations in luminance due to the ringing.

Japanese Unexamined Patent Publication (Kokai) No. 11-327503, described above, has disclosed a configuration in which a plurality of odd X sustain drivers 22-1, 22-2, . . . and a plurality of even X sustain drivers 23-1, 23-2, . . . are arranged alternately and a plurality of odd Y sustain drivers 33-1, 33-2, . . . and a plurality of even Y sustain drivers 34-1, 34-2, . . . are arranged alternately, as shown in FIG. 5. In this configuration, the difference in signal paths from each sustain driver to each X or Y electrode is small and the variations due to the ringing can be reduced. However, there arises a problem: an increase in the number of the sustain drivers causes the number of parts and the area of the circuit substrate to increase, therefore, the cost is increased, as a result.

The present invention has been developed to solve the problem described above, and the object thereof is to suppress the occurrence of the variations in luminance due to ringing with a simplified configuration.

Figure 6:
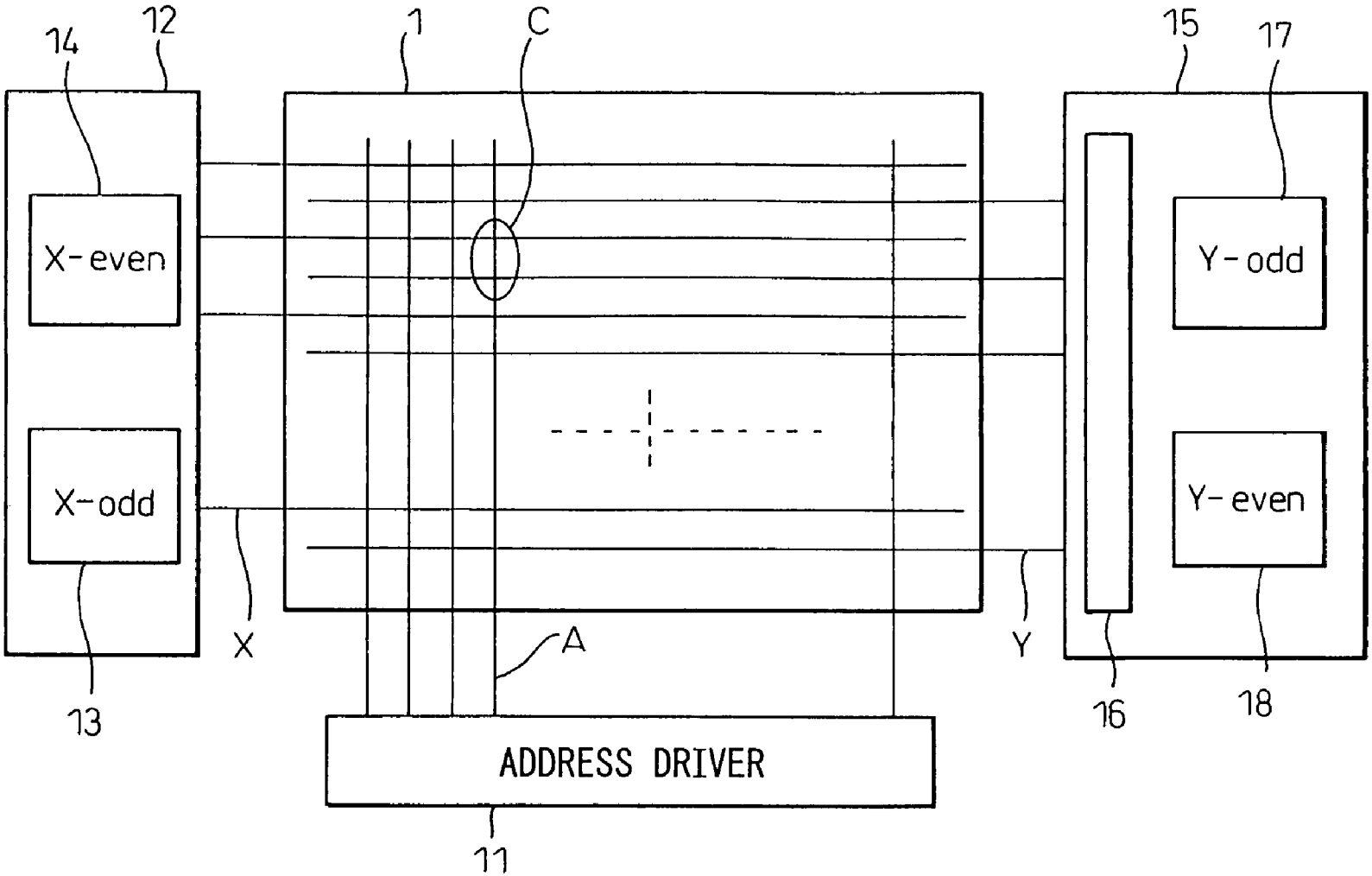
FIG. 6 is a diagram showing the configuration of a PDP apparatus in a first embodiment of the present invention.

FIG. 6 is a block diagram showing the configuration of the ALIS system PDP apparatus in the first embodiment of the present invention. In the conventional case shown in FIG. 1, the odd X sustain driver (X-odd) 13 and the even X sustain driver (X-even) 14, and the odd Y sustain driver (Y-odd) 17 and the even Y sustain driver (Y-even) 18 are arranged in the vertical direction (direction in which the X electrodes and the Y electrodes are arranged), respectively, and the order of arrangement is the same, but in the first embodiment, contrary to this, the order of arrangement of the odd X sustain driver (X-odd) 13 and the even X sustain driver (X-even) 14 is reversed. Others are the same as those in the conventional case and the terminals of the X electrodes and the Y electrodes of the panel 1 are connected to the circuit substrate via the four connectors 41–44.

Figure 7:
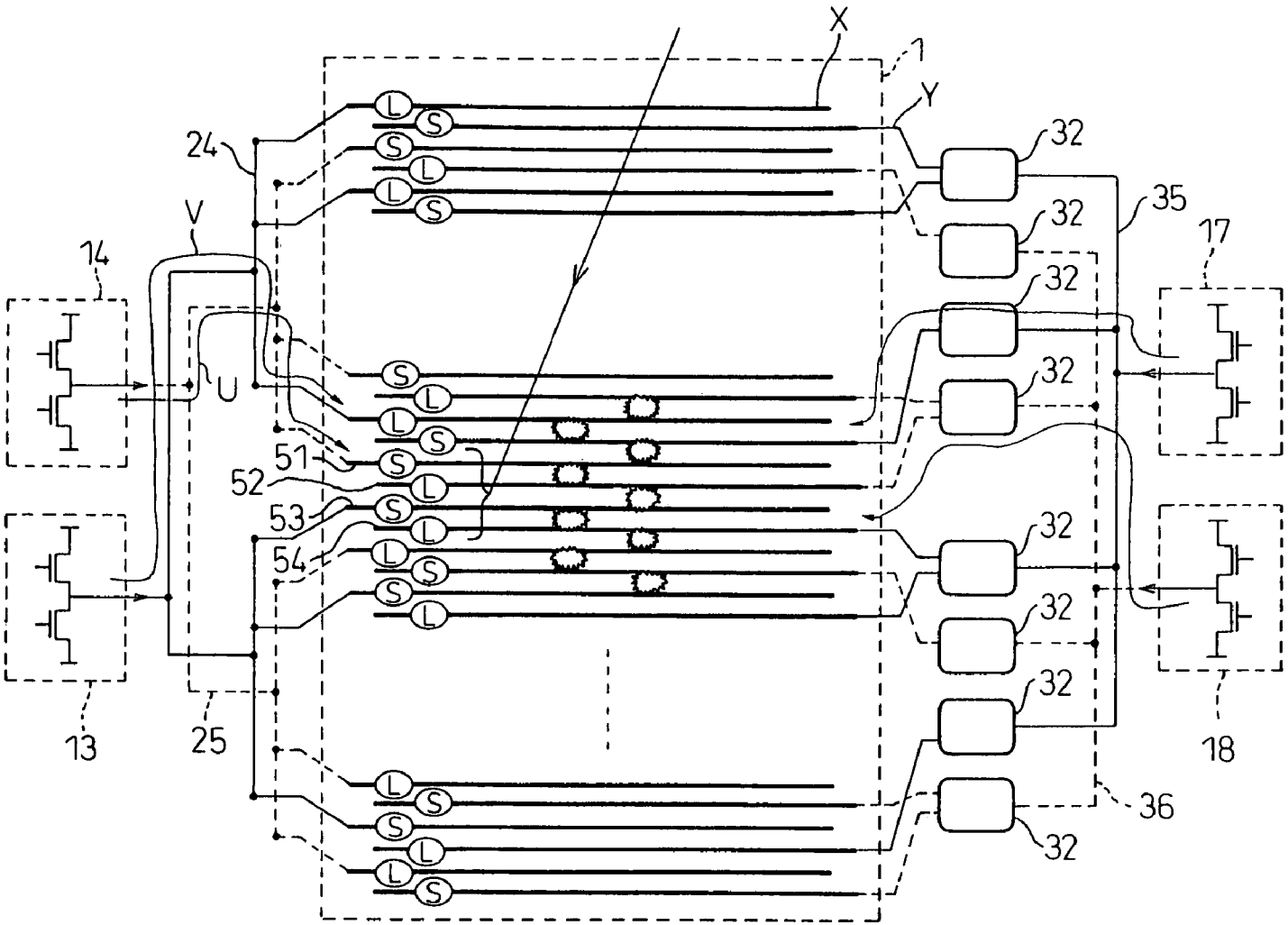
FIG. 7 is a diagram for explaining a state of a ringing in the PDP apparatus in the present embodiment.

FIG. 7 is a diagram, corresponding to FIG. 4, for explaining the path length of the X electrode and the Y electrode in the configuration in the first embodiment.

It is also assumed in the first embodiment that the panel has 501 X electrodes and 500 Y electrodes. As the case of FIG. 4, the two hundred fiftieth X electrode 51 and Y electrode 52, and the two hundred fifty-first X electrode 53 and Y electrode 54 are considered here. The two hundred fiftieth X electrode 51 is connected to the even X sustain driver (X-even) 14 via the connector 41 as shown by a path U. As the X-even 14 is arranged near the connector 41, the signal length becomes relatively short. The two hundred fiftieth Y electrode 52 is connected to the Y-even 18 via the connector 43 and the Y-even 18 is arranged far from the connector 43, therefore, the signal path becomes long. The two hundred fifty-first X electrode 53 is connected to the X-odd 13 via the connector 42 and the X-odd 13 is arranged near the connector 42, therefore, the signal path becomes short. The two hundred fifty-first Y electrode 54 is connected to the Y-odd 17 via the connector 44 therefore the signal path becomes long. As a result, the signal paths of the two X electrodes at the central part are short and those of the two Y electrodes are long.

Moreover, the two hundred forty-ninth X electrode adjacent to the four X electrodes and Y electrodes at the central part is connected to the X-odd 13 situated far via the connector 41 as shown by a path V therefore the signal path becomes relatively long. The signal path of a two hundred fifty-second x electrode is long. Similarly, the signal path of the two hundred forty-ninth Y electrode becomes short and that of the two hundred fifty-second Y electrode becomes short.

In FIG. 7, the path length is shown by "L" when the path length of each X electrode and that of each Y electrode is longer than that of peripheral one, and shown by "S", when shorter. Across the entire surface of the panel, there do not exist, successively, three or more X electrodes and Y electrodes whose path length is long (or short), therefore, lines with high or low luminance are unlikely to occur and the variations in luminance are inconspicuous.

In the first embodiment, as described above, it is possible to suppress the variations in luminance only by changing the order of arrangement of the sustain drivers.

It is desirable that the even X sustain driver (X-even) 14 and the odd X sustain driver (X-odd) 13 are arranged as closely as possible to each other in the vicinity of the display lines at the central part, and also that, in the similarly fashion, the odd Y sustain driver (Y-odd) 17 and the even Y sustain driver (Y-even) 18 are arranged as closely as possible to each other in the vicinity of the display lines at the central part.

Figure 8:
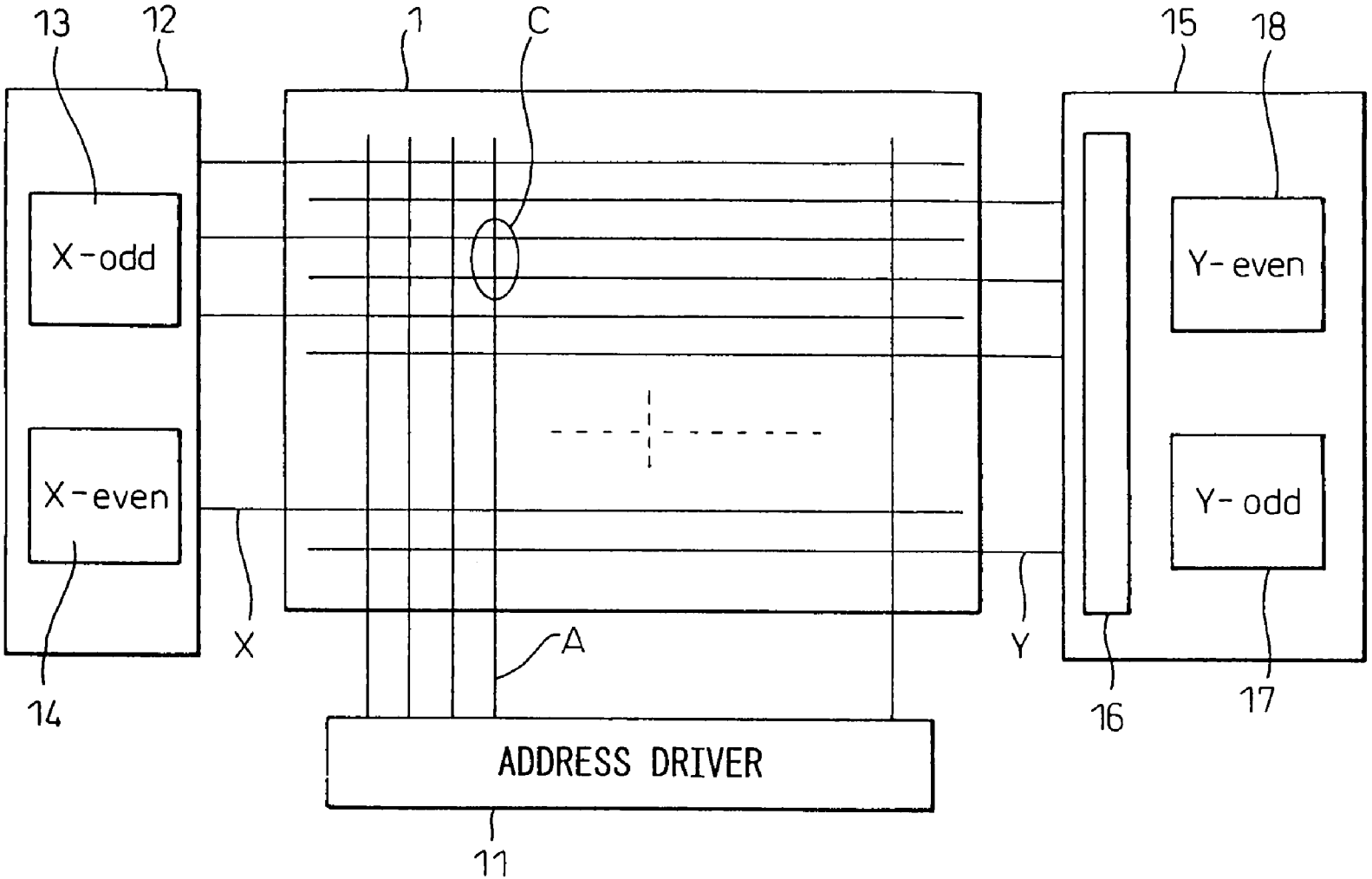
FIG. 8 is a diagram showing the configuration of a PDP apparatus in a second embodiment of the present invention.

FIG. 8 is a diagram showing the configuration of a PDP apparatus in a second embodiment of the present invention. In the first embodiment, the order of arrangement of the odd X sustain driver (X-odd) 13 and the even X sustain driver (X-even) 14 are reversed in the X electrode drive circuit 12, but in the second embodiment, the order of arrangement of the odd Y sustain driver (Y-odd) 17 and the even Y sustain driver (Y-even) 18 are reversed in the Y electrode drive circuit 15. Other parts are the same as those in the first embodiment. In the second embodiment also, the same effect as that in the first embodiment can be obtained.

Figure 9:
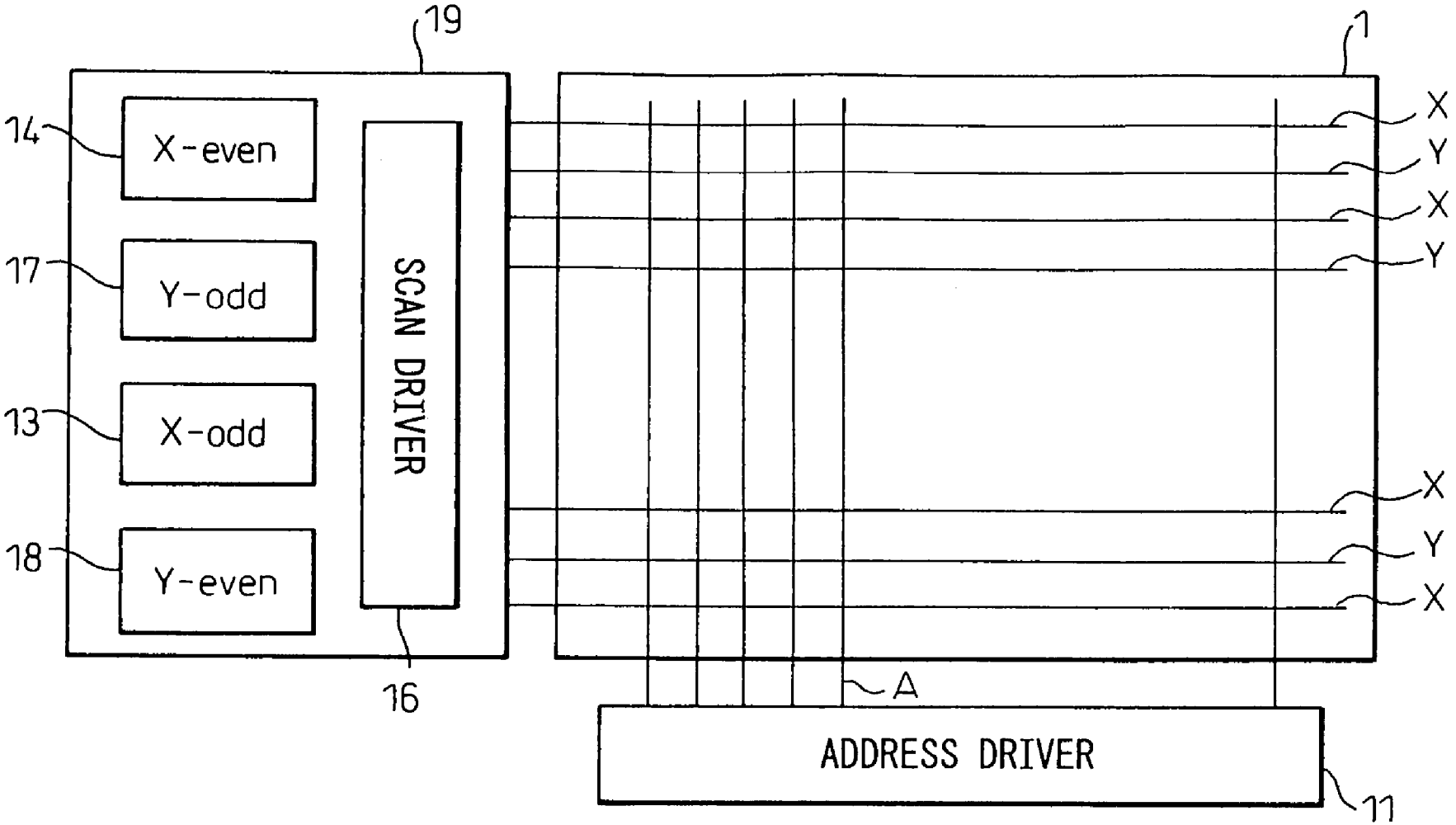
FIG. 9 is a diagram showing the configuration of a PDP apparatus in a third embodiment of the present invention.

FIG. 9 is a diagram showing the configuration of a PDP apparatus in a third embodiment of the present invention. In the first and second embodiments, the panel 1 is used, on which the terminal of the X electrode is provided at one of the ends in the first direction in which the X and Y electrodes extend on the panel 1, and the terminal of the Y electrode is provided at the other end, and the connectors 41 and 42 are provided at one end and the connectors 43 and 44 are provided at the other. However, it is also possible to provide the terminals of the X electrode and the Y electrode at one end and, in accordance with this, provide the connectors 41 and 42 at the end, and connect the terminals of the X electrode and the Y electrode to the outside via the connectors 41 and 42. In this case, the number of wires accommodated by one connector is about doubled. The third embodiment is an example in which the present invention is applied to a PDP apparatus having such a panel.

As shown in FIG. 9, in the PDP apparatus in the third embodiment, a connector (not shown) is provided at one end of the panel and a sustain electrode drive circuit substrate 19 is connected thereto. The sustain electrode drive circuit substrate 19 is provided with the scan driver 16 near the connector and, following this, the even X sustain driver (X-even) 14, the odd Y sustain driver (Y-odd) 17, the odd X sustain driver (X-odd) 13 and the even Y sustain driver (Y-even) 18 are provided in this order. As described above, the order of arrangement of the odd X sustain driver 13 and the even X sustain driver 14 is opposite to that of the odd Y sustain driver 17 and the even Y sustain driver 18, and the same effect as that in the first embodiment can be obtained.

As described above, according to the present invention, by only changing the order of arrangement of the sustain drivers, it is possible to make the display lines with high or low luminance, due to ringing, inconspicuous and to reduce the variations in luminance.

We claim:

1. A plasma display apparatus comprising:

a display panel having a plurality of first and second electrodes arranged alternately and extending in a first direction, and a plurality of third electrodes extending in a second direction perpendicular to the first direction;

a first odd electrode drive circuit for outputting a sustain discharge pulse to be commonly applied to odd-numbered electrodes of the plurality of the first electrodes;

a first even electrode drive circuit for outputting a sustain discharge pulse to be commonly applied to even-numbered electrodes of the plurality of the first electrodes;

a second odd electrode drive circuit for outputting a sustain discharge voltage pulse to be commonly applied to odd-numbered electrodes of the plurality of the second electrodes; and a second even electrode drive circuit for outputting a sustain discharge pulse to be commonly applied to even-numbered electrodes of the plurality of the second electrodes, wherein a sustain discharge is caused to occur between the plurality of the first and second electrodes for a light emission display, and wherein the first odd electrode drive circuit and the first even electrode drive circuit, and the second odd electrode drive circuit and the second even electrode drive circuit, are arranged side by side in the second direction on the display panel, and the order of arrangement in the second direction of the first odd electrode drive circuit and the first even electrode drive circuit is opposite to that of arrangement in the second direction of the second odd electrode drive circuit and the second even electrode drive circuit.

2. A plasma display apparatus, as set forth in claim 1, wherein the first odd electrode drive circuit and the first even electrode drive circuit are arranged side by side in the second direction on one side in the first direction on the display panel, the second odd electrode drive circuit and the second even electrode drive circuit are arranged side by side in the second direction on the other side in the first direction on the display panel, and the order of arrangement in the second direction of the first odd electrode drive circuit and the first even electrode drive circuit is opposite to that of arrangement in the second direction of the second odd electrode drive circuit and the second even electrode drive circuit.

3. A plasma display apparatus, as set forth in claim 1, wherein the first odd electrode drive circuit and the first even electrode drive circuit, and the second odd electrode drive circuit and the second even electrode drive circuit, are arranged side by side in the second direction on one side in the first direction on the display panel, and the order of arrangement in the second direction of the first odd electrode drive circuit and the first even electrode drive circuit is opposite to that of arrangement in the second direction of the second odd electrode drive circuit and the second even electrode drive circuit.

4. A plasma display apparatus, as set forth in claim 1, wherein the first odd electrode drive circuit and the first even electrode drive circuit, and the second odd electrode drive circuit and the second even electrode drive circuit, have two connectors, each, for outputting the sustain discharge pulse to the first electrodes or to the second electrodes, wherein the two connector are arranged in parallel to each other in the second direction, and wherein one of the two connectors connects the first electrodes and the second electrodes provided on one of substantial half sides in the second direction of the display panel, and the other of the two connectors connects the first electrodes and the second electrodes provided on the other substantial half side in the second direction of the display panel.

* * * * *